US006749528B2

(12) United States Patent
Wengert

(10) Patent No.: US 6,749,528 B2
(45) Date of Patent: Jun. 15, 2004

(54) APPARATUS AND METHOD FOR PLAYING GOLF USING A BALL LAUNCHER

(76) Inventor: Wilson S. Wengert, 6 Sabal Island Dr., Boca Raton, FL (US) 33435

( * ) Notice: Subject to any disclaimer, the term of this patent is extended or adjusted under 35 U.S.C. 154(b) by 0 days.

(21) Appl. No.: 09/975,712

(22) Filed: Oct. 9, 2001

(65) Prior Publication Data

US 2003/0069091 A1 Apr. 10, 2003

(51) Int. Cl.[7] ..... A63B 53/00

(52) U.S. Cl. ..... 473/409; 473/195; 124/16; 124/60

(58) Field of Search ..... 473/175, 195, 473/197, 176, 409; 124/16, 60, 63–66, 56

(56) References Cited

U.S. PATENT DOCUMENTS

| | | | | | |
|---|---|---|---|---|---|
| 2,577,186 | A | | 12/1951 | Florer | |
| 3,231,280 | A | * | 1/1966 | Collins | 473/195 |
| 3,467,388 | A | * | 9/1969 | Weiler | 473/196 |
| 3,777,548 | A | * | 12/1973 | Nicolaides | 73/12.02 |
| 4,335,701 | A | * | 6/1982 | Bozich | 124/26 |
| 4,424,972 | A | | 1/1984 | Vinette | |
| 4,805,583 | A | * | 2/1989 | Mosser | 124/20.1 |
| 4,852,543 | A | * | 8/1989 | Mosser | 124/20.1 |
| 4,873,964 | A | | 10/1989 | Bonoan | |
| 4,932,670 | A | | 6/1990 | Brown | |
| 5,507,271 | A | | 4/1996 | Actor | |
| 5,522,594 | A | | 6/1996 | Taylor et al. | |
| 6,139,440 | A | | 10/2000 | Taylor | |
| 6,167,878 | B1 | | 1/2001 | Nickerson et al. | |
| 6,203,456 | B1 | | 3/2001 | Ossege | |
| 6,244,598 | B1 | | 6/2001 | Conville | |

* cited by examiner

*Primary Examiner*—Steven Wong
(74) *Attorney, Agent, or Firm*—John C. Smith

(57) ABSTRACT

A ball launching device which eliminates the need for golf clubs so that disabled individuals can play golf without having to swing a golf club. The ball launching device is configured in the form of the rifle so that it can be carried by a player while the player is walking or riding a golf cart. Alternatively, the golf ball launcher can take any suitable shape in addition to that of a rifle. A preferred version of the golf ball launcher uses a piston assembly that impacts a golf ball and shoots it toward a golf green. The golf ball can be caught on the golf green by a container, or by a receptacle or net which is integrated with the flag pole on the golf green. Alternatively, the player in use the golf ball launcher until the ball reaches the green, and at that point the player can use a conventional putter while on the golf green. The ball launching device is suitable for disabled individuals and/or individuals who wish to play a round of golf in a rapid manner without the inconvenience of carrying an entire set of golf clubs, a golf bag, etc.

15 Claims, 11 Drawing Sheets

APPARATUS AND METHOD FOR PLAYING GOLF USING A BALL LAUNCHER

BACKGROUND OF THE INVENTION

1. Technical Field

The present invention relates to a method of playing a modified game of golf. In particular, it relates to a method of using an adjustable ball launcher, which in one embodiment can be configured as a rifle, for the purpose of playing golf without using golf clubs. Instead, the game is played by shooting golf balls toward a golf green with the ball launcher. The ball launcher allows not only healthy individuals to play a variation of the game of golf, but it also allows disabled individuals to play golf even though they may not be able to swing a golf club.

2. Background Art

The game of golf has provided many individuals with the ability to relax and enjoy the outdoors while playing an enjoyable sport. However, many individuals are unable to enjoy the game because physical disabilities prevent them from being able to swing golf club. Likewise, many individuals would prefer to play golf in a faster manner, without the inconvenience of having to carry many different clubs.

The prior art has attempted to address this problem in several ways. For example, one known device uses a sling shot which is mounted to a golf cart. This device allows a disabled individual who is unable to swing a golf club, and even an individual who is unable to stand, to play golf by shooting golf balls from the comfort of the golf cart while in a sitting position. Unfortunately, the inherent inconsistency and inaccuracy of a sling shot device detracts from the golfer's enjoyment of the game. Likewise, the device also requires the use of a golf cart which is not desirable to those golfers who wish to walk the golf course during play. It would be desirable to have a method of accurately launching golf balls without having to use unnecessary equipment, such as a golf cart, as a launching platform.

Other prior art attempts to assist disabled individuals have included large and cumbersome frame assemblies which hold a conventional golf club. The frame assemblies are spring loaded and allow the golf club to be automatically swung when triggered. A disadvantage associated with this type of device is the cumbersome nature of the device itself. In addition, this type of device is very difficult to properly aim, and can result in a substantial amount of frustration for the golfer.

Another type of known device used for disabled golfers is a ballistic golf club. A ballistic golf club uses a golf face which is powered by explosive cartridges, such as those used in blank guns. In use, the golfer places the face of the golf club next to the golf ball. Next, a trigger on the golf handle is pressed by the golfer which discharges an explosive cartridge in the golf head. In turn, the explosive cartridge propels the face of the golf club into the golf ball which launches the golf ball down the fairway. This type of device is difficult to use because very slight variations in the angle of the golf club can result in substantial errors being injected into the path of the golf ball.

While addressing the basic desirability of providing alternatives to the conventional game of golf, the prior art has failed to provide a clubless golf game which is inexpensive to manufacture, does not interfere with the conventional use of a golf course, and can be used equally by disabled individuals as well as healthy individuals who prefer a faster version of the game of golf.

SUMMARY OF THE INVENTION

The present invention solves the foregoing problems by providing a ball launcher which can be carried by a player while the player is walking or riding a golf cart. The golf ball launcher eliminates the need for golf clubs. The golf ball launcher is preferably designed to resemble a rifle, but can take any other suitable shape. The golf ball launcher uses a piston assembly which impacts a golf ball, or other type of suitable ball, and shoots the golf ball toward a golf green. The piston drive can be powered by air pressure from a manual pump or from a gas canister. Alternatively, explosive charges or spring loaded mechanisms can be used in place of air pressure. In addition, another alternative embosiment uses a pistonless golf ball launcher that launches the golf ball by direct application of air pressure. The golf ball can be caught on the golf green by a container, or by a standalone receptacle or net which is integrated into the flag pole on the golf green. Alternatively, the player can use the golf ball launcher until the ball reaches the green, and at that point the player can use a conventional putter while on the golf green.

DESCRIPTION OF THE PREFERRED EMBODIMENT

Figure 1:
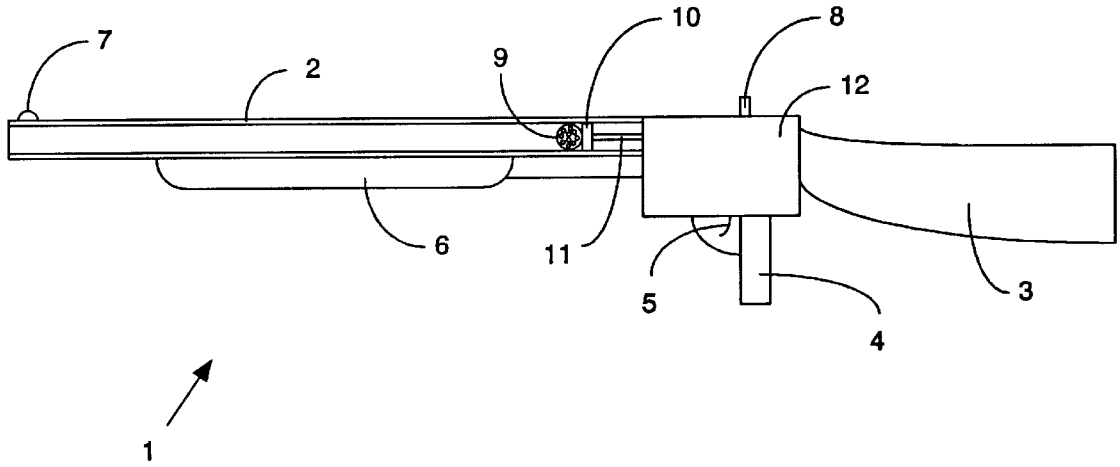
FIG. 1 is a side partial cutaway view of a preferred embodiment of the ball launcher that uses a conventional rifle configuration.

Prior to a detailed discussion of the figures, a general overview of the invention will be presented. As discussed previously, disabled people are often prevented from playing golf due to the inability to swing a club. Likewise, individuals may not have interest in playing a conventional golf game due to the necessity to have a complete set of clubs, as well as dissatisfaction with the slowness of a conventional golf game. It is the intent of this invention to provide a new and faster playing game of golf which replaces the conventional set of golf clubs with a golf ball launcher.

The game and ball launcher presented herein, provides individuals with the ability to play a round golf without having to have the physical ability to swing a golf club, and without the inconvenience of having to have a set of golf clubs to play a round of golf. The golf ball launcher is a preferably a rifle-like device which allows a player to fire a golf ball from the tee toward a golf green. The player then proceeds to where the golf ball landed and then reloads the golf ball into the launcher. The player then fires the golf ball launcher from that spot in the same manner that the player would hit a golf ball with a golf club in a conventional game of golf. The golf ball launcher eliminates the need for the player to have the physical ability to swing a club. Likewise, even a healthy individual capable of swinging a golf club may prefer the convenience of being able to carry a single device rather than the cumbersome set of golf clubs. In addition, the use of the golf ball launcher speeds up the golf game by eliminating many of the time-consuming aspects of club selection, etc.

In the preferred embodiment, the golf ball launcher is structured in the form of a rifle. For ease of discussion, the terms "golf ball launcher" and "rifle" will be used interchangeably herein. The rifle is aimed by the player and the golf ball is shot out of its barrel toward the green. Rather than having to select a desired club or clubs to prepare for the next swing, the player merely walks or rides directly to where the ball is, reloads and aims the rifle and takes the next shot. In this manner, the player is able to very rapidly move through the fairway toward the green. Due to the inherently superior directional control provided by the rifle over conventional clubs, the pace of play is substantially improved. Another benefit of this invention, as opposed to a conventional golf game which requires golf clubs, is that damage to the fairway from golf club divots is completely eliminated because the golf clubs that cause them are not used. This allows the fairways to be kept in better repair with greater ease.

The horizontal distance the golf ball travels can be controlled in several ways. For example, if a specific amount of force is applied to launch a golf ball, the golfer can control the horizontal distance traveled by the golf ball by varying the amount of elevation of the ball launcher which will affect the arc of the ball, and thereby control the horizontal distance. On the other hand, the preferred way of controlling the distance would be to selectively vary the amount of force applied to the ball by the ball launcher. In the case of a rifle based ball launcher which uses a manual pump to provide air pressure, the golfer can control the amount of air pressure based on the amount of times the pump compresses air into an air cylinder. If a gas canister is used to supply air pressure, a pressure valve can be used which will allow the golfer to dial in the amount of pressure to be used for a particular shot. In the case where explosive charges are used, different charge sizes can be used to control distance. As can be seen, there are a variety of ways to control the amount of force applied to a golf ball by the ball launcher. As a result of providing the golfer the ability to control the distance that the golf ball is projected, the rifle used by this invention allows the golfer to simulate an entire set of golf clubs with a single device.

Since no golf clubs are used, including a putter, once the player approaches the green, an alternative to the traditional cup is used. In one form, a large open mouthed container, which may be similar to an air vent on a ship, can be used as a target which substitutes for the cup on a conventional golf hole green. The player shoots the golf ball into the container to complete the hole. This embodiment allows the rifle device to be used exclusively for the game without the use of any golf clubs. However, it does have a drawback in that the presence of the open mouthed container creates an obstruction which would interfere with play by conventional golfers who may also be on the golf course.

An alternative to the open mouthed container eliminates this disadvantage. In the alternative embodiment, a target is integrated with the flag which is normally set in the cup on the green of every hole. In this embodiment, the target can be set above or below the flag, and has a large rim which forms an aperture. The aperture has a net or sock attached to the rim to capture the golf ball when it is shot through the aperture. This embodiment allows conventional golfers, and golfers using the ball launcher system of this invention, to play together on the same course without interfering with one another.

Scoring would preferably be kept in the same manner as it is kept in conventional golf.

Another alternative embodiment eliminates the need for any change to the golf green. In particular, the open mouthed container and the target integrated with the flag can be eliminated entirely. This can be accomplished by the user carrying a single club in addition to the rifle: a putter. The golf ball rifle would be used to move the ball from the tee across the fairway to the green. Once on the green, the putter would be used to sink the ball in the conventional manner. As a result, this new version of golf can be played with no changes to the golf course.

In the case of many disabled golfers, the physical inability to take a full swing to hit a golf ball down the fairway will not interfere with their ability to putt once on the green. This embodiment does create the inconvenience of having to carry a club. However, it also allows players using the golf ball rifle to use a golf course with absolutely no effect on, or interference with, conventional golfers. The golf green would be kept in exactly the same manner as it always has been kept. The only differences perceived by players on the course would be the increased speed of play by those using the golf ball launcher, and the elimination of any damage to the fairway caused by divots which are created by conventional golf club impacts on the fairway. This embodiment also eliminates the need for golf courses to make any changes whatsoever to the golf course to accommodate players using the golf ball launcher.

Those skilled in the art will recognize that a separate putter can be carried, or for convenience, a collapsible putter can be stored in the rifle (for example, in a compartment in the rifle stock) so that the golfer still only has to carry a single device. By attaching a putter to the golf ball launcher, the inconvenience of carrying a putter in this embodiment is eliminated. It is even possible to incorporate a putter into the ball launcher itself such that it can be extended for use as a putter when the player is on the green, and retracted so that it does not interfere with play when the player is on the tee or the fairway. As can be seen, the ball launcher used by this form of golf game can be implemented with absolutely no change to a golf course or no requirement for additional equipment on the golf course.

While a rifle configuration may be the most convenient to use, those skilled in the art will recognize that a variety of alternative embodiments of the ball launcher can be used. For example, any convenient physical configuration of the golf ball launcher which can be easily aimed and carried can be used. Likewise, a golf ball launcher, even one configured as a rifle, can actually be mounted on a golf cart so that it does not have to be carried at all.

Regardless of the physical shape of the golf ball launcher, a method of propelling the golf ball must be provided by the golf ball launcher. For example, the golf ball launcher may be configured with a manual air pump such as that used by conventional BB guns. These typically have a manually operated sliding pump that is slidably attached to the barrel. That type of sliding pump mechanism, well-known in the art, can be used by the player to pump up sufficient air pressure to drive a piston in the golf ball launcher which will impact the golf ball and launch it from the rifle. In fact, the player can control the distance the golf ball is propelled based on the amount of air pressure created by the player via the pump. Alternatively, a canister filled with pressurized gas, such as air, can be used to supply the ball launcher with sufficient pressure to launch the ball. In this embodiment, the ball launcher would preferably include an adjustable pressure valve to allow the player to control the distance that the ball is propelled. When using a compressed gas propellent, the gas canister can be incorporated into the golf ball launcher, or carried separately with the gas supplied to the golf ball launcher via a conduit. While the gas should preferably be compressed air, any other suitable gas can be used. There are several advantages to physically separating the gas canister from the rifle. For example, by separating the gas canister from the rifle, a larger gas canister with a larger supply of compressed gas can be used. In addition, if the canister is carried in a convenient manner, such as on a backpack or mounted on a golf cart, the rifle will be lighter and easier to manipulate and aim.

Compressed gas is only one method of propelling the golf ball. An alternative method would be to use a spring loaded piston drive assembly. The spring in the spring loaded piston drive assembly can be compressed in the same manner as air is compressed using a manual pump, and can be incorporated into the rifle. Preferably, by using a ratchet assembly (ratchet assemblies are well known in the art), the player can adjustably increase spring tension to control golf ball flight distance.

Another alternative embodiment uses explosive cartridges similar to those used with golf club impellers in prior art golf clubs. The explosive cartridges are lightweight and require no effort on the part of the player to use, as compared to embodiments such as the manual air pump. However, they do incur a cost to the player since explosive cartridges are expendable items which must be replaced after each use.

Those skilled in the art will recognize that any suitable energy source may be used to propel the golf ball. For example, an electrical drive mechanism, powered by a battery source (rechargeable or disposable), can be used.

As can be seen from the foregoing, a variety of methods can be used to generate the force necessary to propel the golf ball. The only requirements are that the golf ball is propelled a sufficient distance and that the player be able to control the distance for a given shot. By controlling the distance, a golf ball launcher can substitute for an entire set of golf clubs, each of which is designed to propel a golf ball a set distance in relation to the other golf clubs. As a result, a single ball launcher, which is much lighter and easier to carry then an entire set of golf clubs, can be used to play an entire round of golf. We turn now to a more detailed discussion of the figures.

Referring to FIG. 1, this figure illustrates a side cutaway view of a preferred embodiment of a ball launcher 1 that uses a conventional rifle configuration. The ball launcher 1 has a barrel 2 sized to fit a golf ball 9. For ease of discussion, the term "golf ball" 9 is used to describe the ball used for the purpose of the new golf game disclosed herein. However, those skilled in the art will realize that while a conventional golf ball 9 can be used by the ball launcher 1, any other suitable ball may be used. Therefore, for the purpose of this disclosure, the term "golf ball" is intended to include not only golf balls 9 which are conventional golf balls, but any other suitable ball which may have a varying mass and/or diameter. The only requirement is that it can be conveniently launched and used to play the golf game disclosed herein. When the ball launcher is fired, the golf ball 9 is struck by a piston head 10 which is connected to a piston rod 11. The piston rod 11 is moved by the drive assembly 12 which may used any of the power sources described above, such as the manual air pump, compressed gas supplied, battery powered electric drive, explosive charge, etc. While this figure describes a drive assembly 12 which can be powered by a variety of sources, several embodiments are described in the following figures which use specific forms of piston drive assemblies 12.

A slide mechanism 6 can be used by the player to adjust the amount of force made available to propel the golf ball 9. Other components illustrated in this figure are identical to those found in a conventional rifle. For example, the stock 3 is used to support the ball launcher 1 against the player's shoulder, the handle 4 is used to support the player's hand while the player activates the trigger 5 to fire the ball launcher 1, and the distal site 7 and the proximal site 8 are used to aim the ball launcher 1 in the same manner as a conventional rifle is aimed.

Those skilled in the art will recognize that alternative drives can be used in place of the piston rod 11 and piston head 10. For example, where compressed air is used, the compressed air can be forced directly against the golf ball 9 to launch it without requiring use of the piston head 10 or the piston rod 11.

Figure 2:
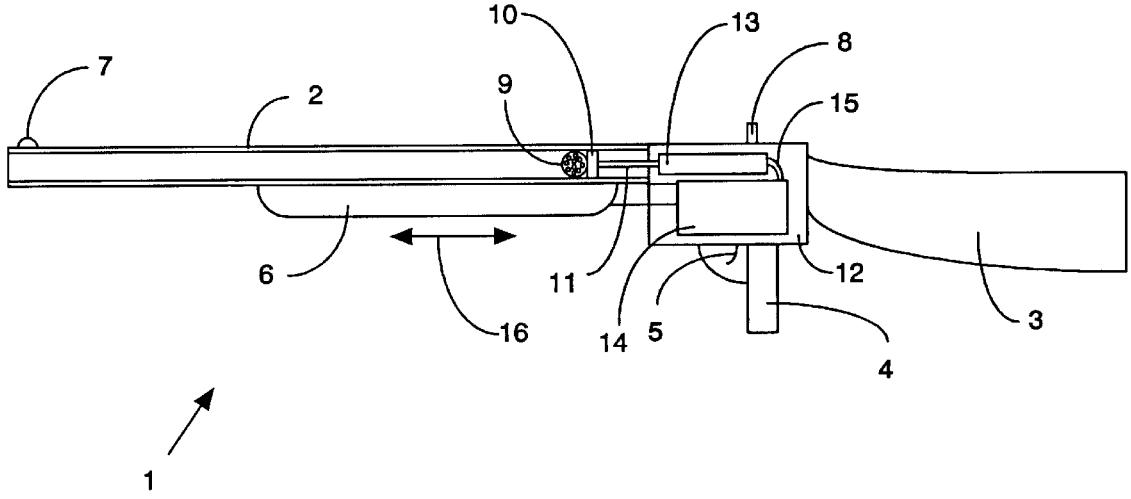
FIG. 2 is a side partial cutaway view of a preferred embodiment of the golf ball launcher that uses a conventional rifle configuration in combination with a manual air pump.

In FIG. 2, a side partial cutaway view of a preferred embodiment is illustrated in which the ball launcher 1 uses a conventional rifle configuration in combination with a manual air pump powered by a slide mechanism 6. In this embodiment, the slide mechanism 6 is moved by the player back and forth along line 16. When the slide mechanism 6 is activated in this manner, it compresses air into compressed air chamber 14. When the player is ready to fire the golf ball 9, the trigger 5 is pressed which releases air from the compressed air chamber 14 via conduit 15 into piston chamber 13. The compressed air forces the piston 10 which is attached to piston rod 11 into the barrel 2 where piston 10 impacts golf ball 9 which is then propelled through and ejected from barrel 2. Manual air pumps and trigger devices are well known in the art.

Figure 3:
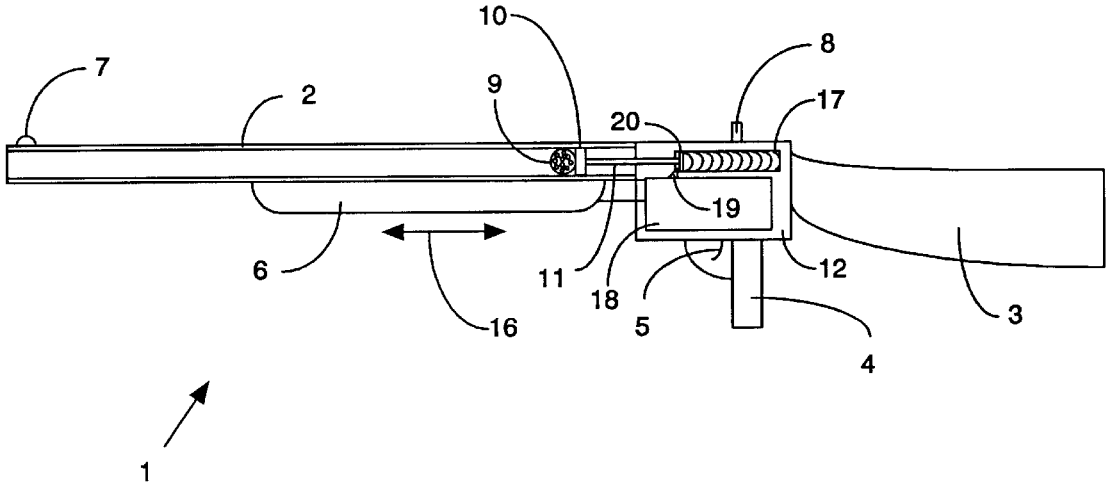
FIG. 3 is a preferred embodiment of a rifle powered by a spring launcher and a manually operated ratchet assembly.

FIG. 3 shows an alternative preferred embodiment of a rifle 1 powered by a spring launcher and a manually operated ratchet assembly. In this embodiment, the same type of manually operated slide mechanism 6 is used which was used in the previous embodiments. However, in this embodiment the slide mechanism 6 is used to activate a ratchet assembly 18 which drives a ratchet tooth 19 against a spring compression wall 20 which is attached to the piston rod 11. As the ratchet tooth 19 moves the spring compression wall 20 toward the rifle stock 3, it compresses a spring 17. When the trigger 5 is pressed, the ratchet tooth 19 is pulled away from the spring compression wall 20 which is then released. As soon as the compression wall 20 is released, the tension in the spring 17 drives the spring compression wall 20, the piston rod 11, and the piston 10 forward until the piston 10 impacts golf ball 9 and shoots it out of the barrel 2.

Ratchets are well known in the art. Preferably, the ratchet assembly 18 used in this embodiment includes a gear assembly (not shown) which will allow the manually operated slide mechanism 6 to be pumped several times in order to fully compress the spring 17. By gearing down the manually operated slide mechanism 6 in this manner, the player is able to adjust the amount of force applied by a spring 17 to the golf ball 9. In turn, this allows the player to adjust the distance that the golf ball 9 is shot.

Figure 4:
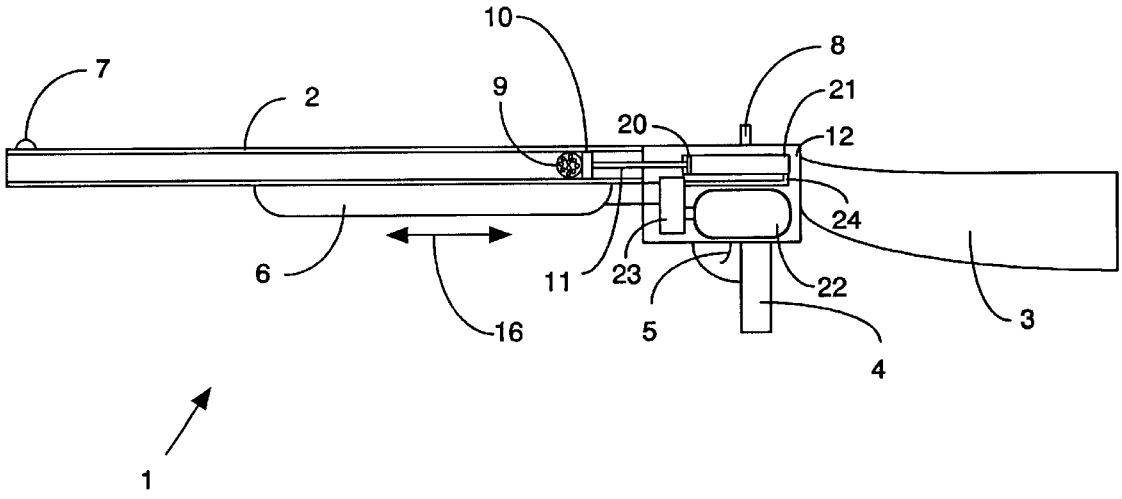
FIG. 4 is a preferred embodiment of a rifle in which the golf ball launcher is powered by an internal gas canister.

FIG. 4 shows another alternative preferred embodiment of a golf ball launcher 1 in which the golf ball launcher 1 is powered by an internal compressed gas canister 22. For ease of discussion, the term "gas canister" is used herein. However, it is understood that any suitable type of gas can used, including air. In this embodiment, the removable compressed gas canister 22 is stored at a convenient location within the rifle 1. Those skilled in the art will recognize that while the compressed gas canister 22 is illustrated as being stored within the drive assembly 12, it could be stored in any convenient location, such as the stock 3, etc. The compressed gas canister 22 is attached to a valve assembly 23 which is controlled by operation of the manually operated slide mechanism 6. Each time the manually operated slide mechanism 6 is activated by the player, a selected amount of gas is fed from the compressed gas canister 22 through valve assembly 23, and then to gas operated piston cylinder 21 via gas conduit 24. The manually operated slide mechanism 6 allows the player to control the amount of gas pressure in gas operated piston cylinder 21. By controlling the gas pressure, the player can control the amount of force applied by the piston 10 to the golf ball 9, and thereby control the distance that the golf ball 9 travels. Any suitable gas can be used, including compressed air.

In the preferred embodiment, the compressed gas canister 22 is intended to be easily removed such that it can be quickly replaced during play if the compressed gas canister 22 becomes empty.

Figure 5:
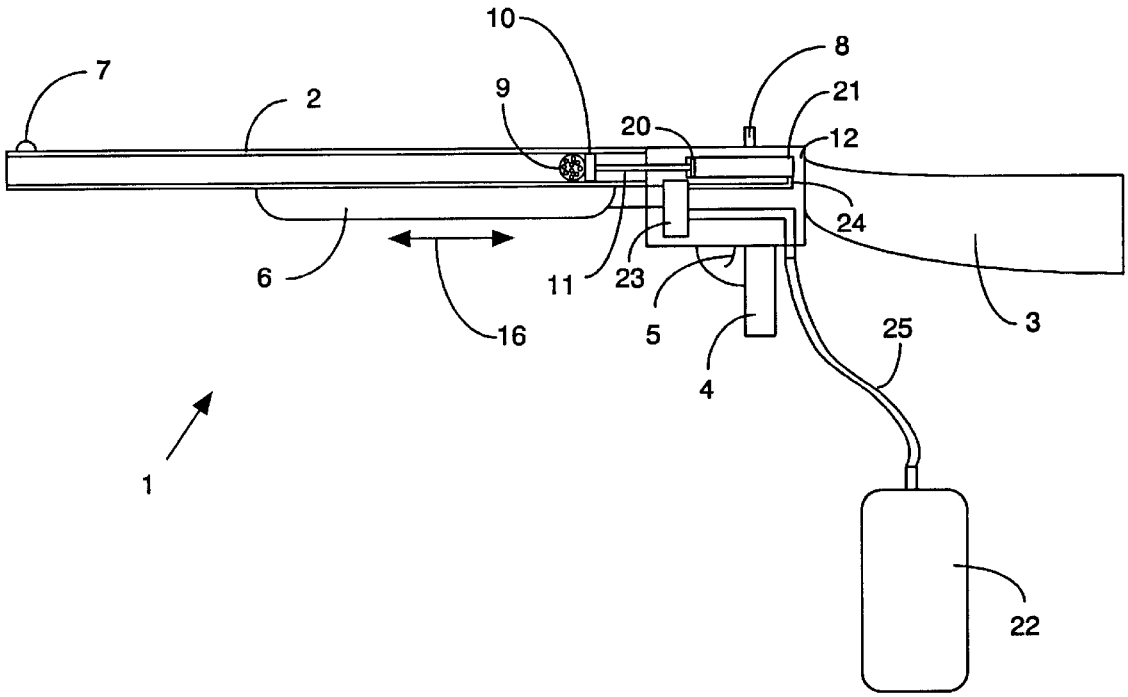
FIG. 5 is a preferred embodiment of a rifle in which the golf ball launcher is powered by an external gas canister.

FIG. 5 shows another preferred embodiment of a golf ball launcher 1 in which the golf ball launcher 1 is powered by an external gas canister 22. This embodiment is functionally equivalent to the embodiment shown in FIG. 4 with the following differences. The internally mounted canister 22 of the previous embodiments is replaced with an external compressed gas canister 22 which is attached to a valve assembly 23 via a flexible conduit 25. This embodiment has several advantages over the previous embodiment. In particular, this embodiment allows the player to carry a much larger supply of compressed gas. In addition, the externally mounted compressed gas canister 22 can be secured to the player via a simple device such as a backpack (not shown). As a result, the weight of the rifle 1 is substantially reduced, which makes it easier for the player to use. In addition, if the player is using a golf cart, then the compressed gas canister 22 can be mounted on the golf cart so that the player only needs to carry the golf ball launcher 1.

Figure 6:
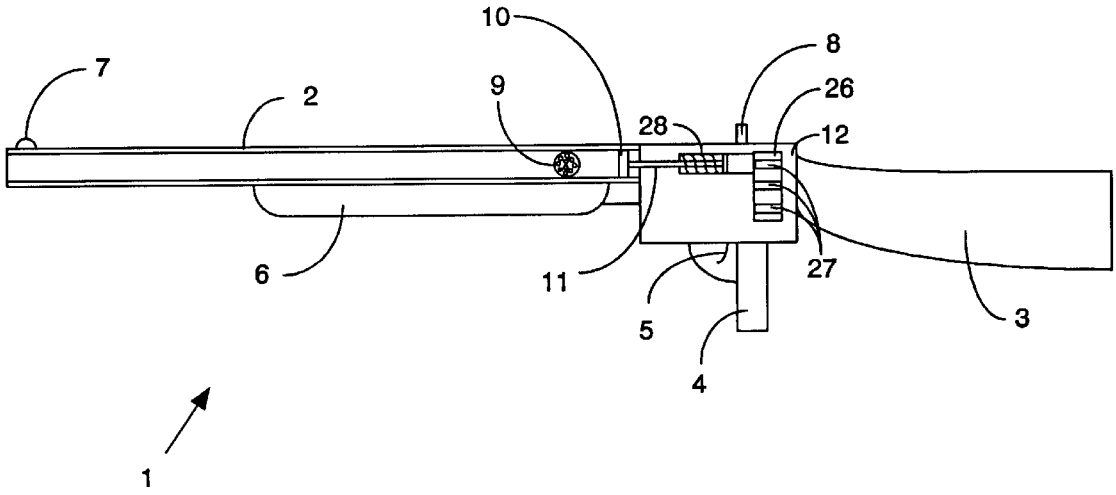
FIG. 6 is another preferred embodiment in which the rifle is powered by an explosive cartridge.

FIG. 6 is another preferred embodiment in which the rifle 1 is powered by an explosive cartridge 27. In this embodiment, the piston rod 11 and piston 10 assembly is held against an explosive cartridge 27 by spring 28. When the trigger 5 is pulled, the explosive cartridge 27 is discharged which overcomes the force of spring 28 and drives the piston 10 into the golf ball 9 which results in the golf ball 9 being shot down the fairway. In this illustration, a cartridge magazine 26 is shown which holds multiple explosive cartridges 27. The cartridge magazine 26 allows the player to take several shots before re-loading. In addition, the explosive power of each explosive cartridge 27 can be selectively varied to provide greater or lesser force to piston 10, and therefore to provide greater or lesser distance when the golf ball 9 is shot.

Figure 7:
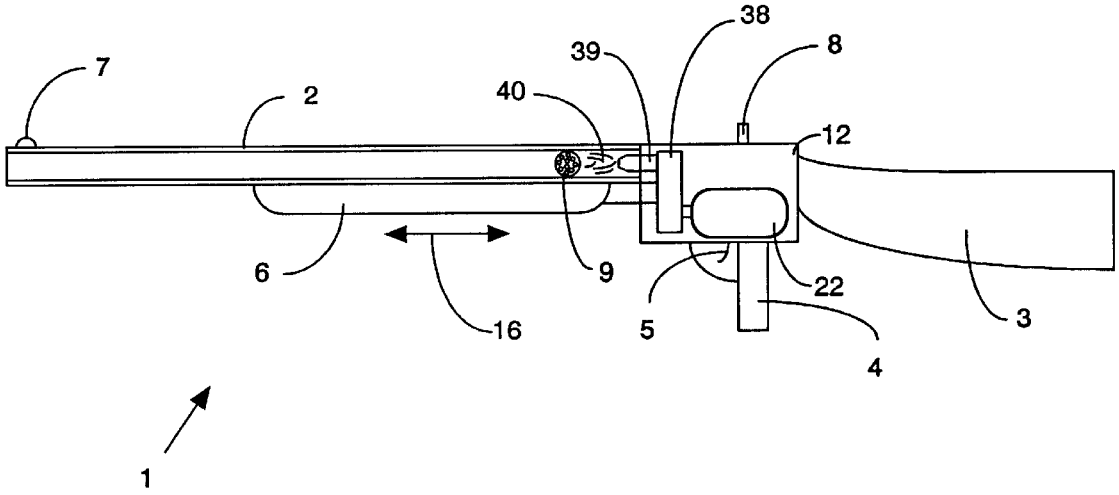
FIG. 7 is another preferred embodiment in which the rifle is powered by a gas nozzle which applies gas pressure directly to the golf ball without a piston drive assembly.

In FIG. 7, an alternative preferred embodiment is illustrated which uses a direct gas drive ball launching mechanism. In this embodiment, a compressed gas canister 22 supplies gas via valve assembly 23 to nozzle 39. When the trigger 5 is activated, the valve 38 releases gas 40 through nozzle 39 under high-pressure. The gas 40 impacts the golf ball 9 and projects it out of barrel 2. In the preferred embodiment, valve assembly 38 is adjustable to allow the player to adjust the amount of gas pressure to be used, which in turn allows the player to control the distance that the golf ball 9 travels. Those skilled in the art will recognize that a simple knob may be used in conjunction with valve assembly 38 to control the pressure used to launch the golf ball 9. However, the enjoyment of the game may be enhanced by using the manually operated slide mechanism 6 to control the amount of gas pressure provided by pumping along line 16 in the same manner as a conventional gun would be loaded.

Figure 8:
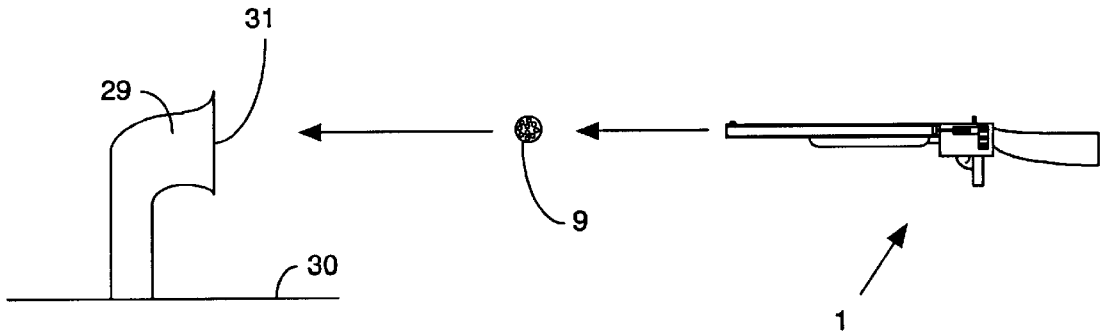
FIG. 8 is a preferred embodiment of a golf ball catcher mounted over a golf hole.

FIG. 8 is a side view of a preferred embodiment of a golf ball catcher 29 mounted over a golf cup on a golf green 30. The golf ball catcher 29 in this illustration can be any suitable shape. The object of the player is to use the golf ball launcher 1 to shoot the golf ball 9 into the aperture 31 of the golf ball catcher 29. This would be equivalent to sinking a putt in a conventional golf game.

Figure 9:
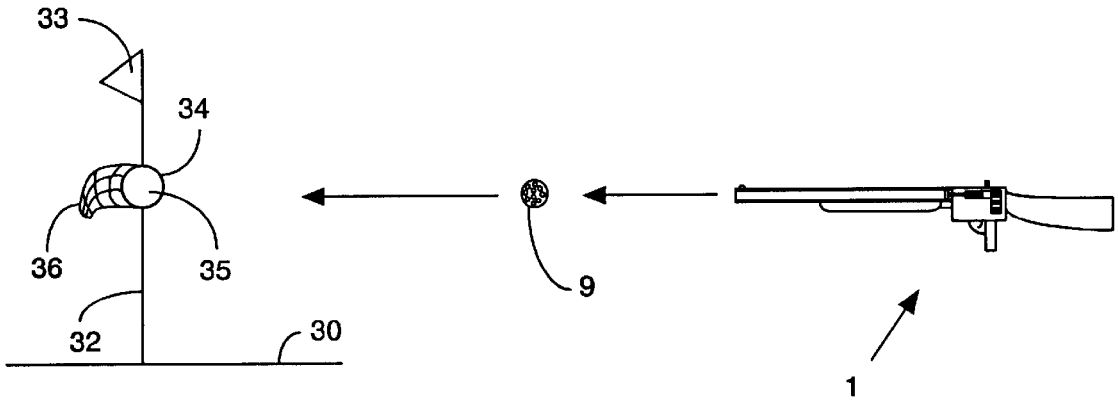
FIG. 9 is a golf hole flag pole with a ball catching net integrated with the pole.

FIG. 9 shows another preferred embodiment of a golf hole flag pole 32 which has an integral ball catching net 36. In this embodiment, the golf ball launcher 1 shoots the golf ball 9 towards an aperture 35 in the ring 34 which forms part of the golf hole flag pole 32. When the golf ball 9 passes through the aperture 35, it is captured by the ball catching net 36. In the new golf game presented herein, this would be equivalent to sinking a putt in a conventional golf game. The advantage of this embodiment is that the golf hole flag pole 32 does not create an obstruction for conventional golfers such as that created by the golf ball catcher 29 in the previous embodiment. As a result, conventional golfers as well as golfers using the ball launcher 1 can be intermixed on a golf course without interfering with one another.

Figure 10:
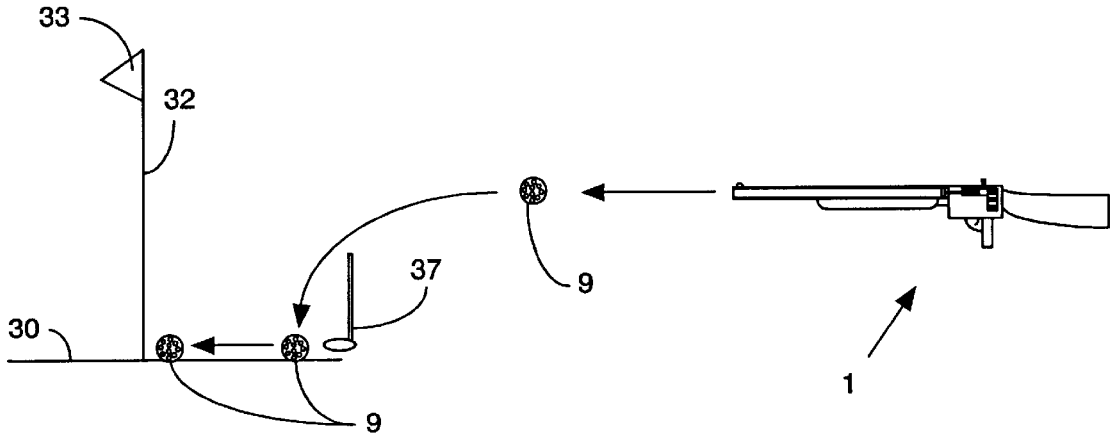
FIG. 10 is an alternative preferred embodiment in which the ball launcher is used to place a golf ball on the golf green, and then the golf ball is putted into the cup with a conventional putter.

FIG. 10 shows an alternative embodiment of the golf game in which the golf ball launcher 1 is used to shoot the golf ball 9 to the golf green 30. Once the golf ball 9 is on the golf green 30, then a conventional putter 37 is used to putt the golf ball 9 to the golf cup at the base of the golf hole flag pole 32. While this embodiment requires that the player carry a putter 37 as well as the rifle 1, it also allows the new version of the golf game implemented by the golf ball launcher 1 to be played on any golf course with absolutely no modification to the golf course.

Figure 11:
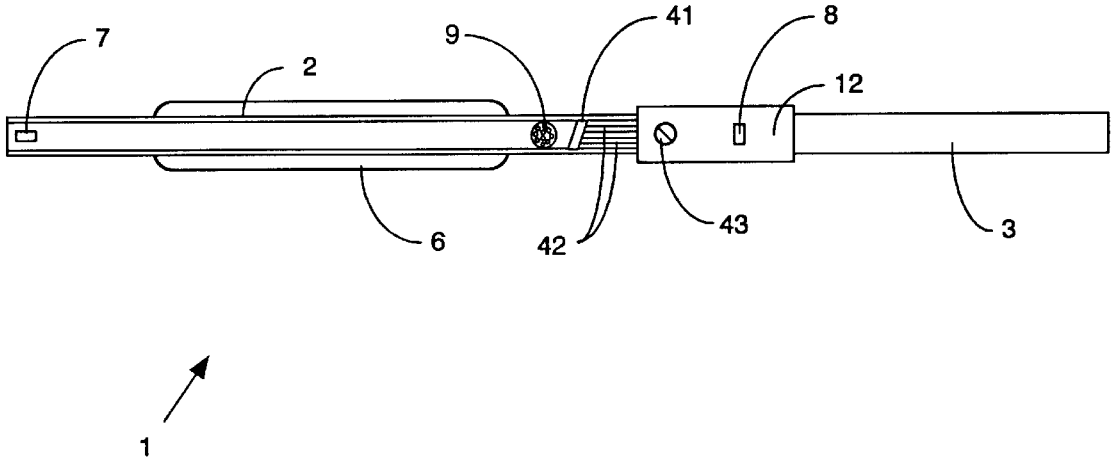
FIG. 11 is a top cutaway view of a preferred embodiment of a rifle based golf ball launcher which uses an adjustable piston head that permits the golfer to intentionally hook or slice the golf ball.

In FIG. 11, a top cutaway view of another preferred embodiment of a rifle based golf ball launcher is shown. This embodiment uses an adjustable piston head 41 that permits the golfer to intentionally hook or slice the golf ball 9. The ability to selectively hook or slice a golf ball 9 may be very advantageous depending on the location of the ball in relation to obstructions on the golf course. In this view, the adjustable piston head 41 is angled in relation to the golf ball 9. By striking the golf ball 9 at an angle, a spinning motion is imparted to the golf ball 9. Depending on the direction of spin, the golf ball 9 will either hook or slice.

By way of example, the adjustable piston head 41 is secured to two piston rods 42 which are adjustable in longitudinal relationship to one another via knob 43. By rotating knob 43, the piston rods 42 will move in relation to one another causing the piston head 41 to change its angle of impact with the golf ball 9. As a result, the player can adjust the piston head 41 such that there is an imparted spin which causes a hook, and imparted spin which causes a slice, or no imparted spin at all. Those skilled in the art will recognize that a variety of techniques can be used to alter the angle of impact of piston head 41 in addition to the dual piston rod 42 embodiment disclosed in this figure.

The advantage provided by this embodiment is that a player can intentionally hook or slice a golf ball 9 in the same manner that a skilled golf player can intentionally hook or slice a golf ball 9 with a conventional golf club. This allows the player to have more control over how the golf ball 9 is moved across the golf hole.

As can be seen from the foregoing examples, the various embodiments provided by the invention allow a golfer to play a round of golf without having to use a set of golf clubs. In addition, the use of the golf ball launcher 1 allows the game to be played at a much faster pace, and with much more convenience, due to the elimination of the need to carry a golf bag with many golf clubs. A further advantage provided by the invention is that use of the golf ball launcher 1 results in zero damage from divots in the fairway which are created by conventional golf clubs.

Those skilled in the art will also recognize that the golf ball launcher 1 can take any shape, and while it can be carried by the player, it can also be constructed such that it is attachable to, or permanently attached to, a conventional golf cart which relieves the player of the burden of carrying the golf ball launcher 1.

While the invention has been described with respect to a preferred embodiment thereof, it will be understood by those skilled in the art that various changes in detail may be made therein without departing from the spirit, scope, and teaching of the invention. For example, the golf ball may be fabricated from any suitable material, and it can vary size and weight. The ball launcher can also vary in shape and is not restricted to the traditional form of a rifle. In fact, it can be structured as a pistol, cross bow, or any suitable shape which provides the desired golf ball propulsion capability. Likewise, the ball launcher may be attached to the golf cart for the player's convenience, etc. While the rules of the game are preferably the same as conventional golf, the rules can be varied to suit this new rifle-based game. Accordingly, the invention herein disclosed is to be limited only as specified in the claims.

I claim:

1. A method of playing a game on a golf course using a golf ball launcher, including the steps of:

for each hole on the golf course having a golf tee, a fairway, a golf green, and a golf cup, advancing a golf ball along the fairway from the golf tee to the golf green, including the steps of:

(a) loading the golf ball into a rifle shaped golf ball launcher, the golf ball launcher sized such that it can be used while walking or while riding in a golf cart, the golf ball launcher further having a barrel with an inner diameter sized to slidably accept the golf ball, a drive assembly attached to the barrel and having means to launch the golf ball from the barrel, and a trigger attached to and controlling the drive assembly such that the drive assembly is activated and the golf ball is launched when the trigger is activated;

(b) launching the golf ball along the fairway toward the golf green by aiming the barrel of the golf ball launcher in the manner of a rifle and activating the trigger to launch the golf ball;

(c) advancing to the golf ball, if the golf ball has not landed on the golf green, repeating steps (a) and (b); and advancing to the golf green; and completing the golf hole when the golf ball reaches a specified target on the golf green.

2. A method of playing a game on a golf course using a rifle shaped golf ball launcher, including the additional steps of:

for each hole on the golf course having a golf tee, a fairway, a golf green, and a golf ball catcher on the golf green, advancing a golf ball along the fairway from the golf tee to the golf green, including the steps of:

(a) loading the golf ball into a rifle shaped golf ball launcher, the golf ball launcher further having a barrel with an inner diameter sized to slidably accept the golf ball, a drive assembly attached to the barrel and having means to launch the golf ball from the barrel, and a trigger attached to and controlling the drive assembly such that the drive assembly is activated and the golf ball is launched when the trigger is activated;

(b) launching the golf ball along the fairway toward an aperture in the golf ball catcher on the golf green; and (c) advancing to the golf ball, if the golf ball has not been caught by the golf ball catcher, and repeating steps (a) and (b).

3. A method, as in claim 2, including the additional step of:

integrating the golf ball catcher into a flag pole on the golf green, the golf ball catcher further having an aperture suitable for receiving a ball, and a net attached to the aperture such that when a ball enters the aperture it is captured.

4. A method, as in claim 1, including the additional step of using a conventional golf putter, once the golf ball has landed on the golf green, to putt the golf ball into a golf ball cup on the golf green.

5. A method, as in claim 1, including the additional step of using compressed gas to provide power to launch the golf ball from the golf ball launcher.

6. A method, as in claim 5, including the additional steps of:

using a supply of compressed gas or air to propel the golf ball by powering a piston drive assembly having a piston head for impacting the golf ball, or by directly propelling the golf ball with the pressurized gas or air; and varying the distance that the ball travels when launched by controlling the force applied to the golf ball by varying the pressure from the supply of compressed gas;

whereby the pressure is varied to control the distance the ball is launched by controlling the amount of driving force applied to the piston rod.

7. A method, as in claim 6, including the additional steps up:

using air as the compressed gas; and using a manual pump, or a powered pump attached to the supply of compressed gas, to increase the pressure in the supply of compressed air when the manual pump is activated.

8. A method, as in claim 6, including the additional step of:

varying the pressure from the supply of compressed gas to the piston drive assembly with a pressure valve;

whereby the pressure is varied to control the distance the ball is launched by controlling the amount of driving force applied to the piston had.

9. A method, as in claim 6, including the additional step of using a gas or air canister, or a pump, to supply gas or air pressure for propelling the golf ball.

10. A method, as in claim 9, including the additional step of storing the gas or air canister, or the pump, within the ball launcher.

11. A method, as in claim 9, including the additional step of storing the gas or air canister, or the pump, externally from the ball launcher and attaching it to the ball launcher via a gas conduit.

12. A method, as in claim 6, including the additional step of adjusting the relative angle of the piston drive assembly in relation to the golf ball such that, when the piston head impacts the golf ball, it imparts a preselected spin on the golf ball; and whereby the golf ball can be selectively hooked or sliced by adjusting the relative angle of the piston head.

13. A method, as in claim 5, including the additional steps of:

using a spring-loaded piston drive assembly, having a piston head, for impacting the golf ball; and varying the distance that the ball travels when launched by controlling the force applied by the piston drive assembly to the golf ball by varying the spring tension that powers the piston drive assembly;

whereby the pressure is varied to control the distance the ball is launched by controlling the amount of driving force applied to the piston rod.

14. A method, as in claim 13, including the additional step of adjusting the relative angle of the piston drive assembly in relation to the golf ball such that, when the piston head impacts the golf ball, it imparts a preselected spin on the golf ball; and whereby the golf ball can be selectively hooked or sliced by adjusting the relative angle of the piston head.

15. A method, as in claim 6, including the additional step of imparting a preselected spin on the golf ball by adjusting the relative angle of the force applied to the golf ball when it is propelled.

* * * * *